US011239037B2

(12) United States Patent
Namikawa

(10) Patent No.: US 11,239,037 B2
(45) Date of Patent: Feb. 1, 2022

(54) BREAKER AND SAFETY CIRCUIT EQUIPPED WITH THE SAME

(71) Applicant: BOURNS KK, Osaka (JP)

(72) Inventor: Masashi Namikawa, Osaka (JP)

(73) Assignee: BOURNS KK, Osaka (JP)

( * ) Notice: Subject to any disclaimer, the term of this patent is extended or adjusted under 35 U.S.C. 154(b) by 0 days.

(21) Appl. No.: 16/976,011

(22) PCT Filed: Feb. 5, 2019

(86) PCT No.: PCT/JP2019/004073
§ 371 (c)(1),
(2) Date: Aug. 26, 2020

(87) PCT Pub. No.: WO2019/167568
PCT Pub. Date: Sep. 6, 2019

(65) Prior Publication Data
US 2021/0104371 A1 Apr. 8, 2021

(30) Foreign Application Priority Data
Feb. 27, 2018 (JP) ..... JP2018-033289

(51) Int. Cl.
*H01H 37/04* (2006.01)
*H01H 37/54* (2006.01)
(Continued)

(52) U.S. Cl.
CPC ..... *H01H 37/04* (2013.01); *H01H 1/504* (2013.01); *H01H 37/5427* (2013.01); *H01H 71/02* (2013.01); *H01H 2229/048* (2013.01)

(58) Field of Classification Search
CPC .... H01H 37/04; H01H 1/504; H01H 37/5427; H01H 71/02; H01H 2229/048
(Continued)

(56) References Cited

U.S. PATENT DOCUMENTS 4,490,704 A * 12/1984 Snider ..... H01H 61/02 337/112
4,862,133 A * 8/1989 Tabei ..... H01H 1/504 337/102
(Continued)

FOREIGN PATENT DOCUMENTS

JP 2006-100054 A 4/2006
JP 2006100054 A * 4/2006 ..... H01H 37/04
(Continued)

OTHER PUBLICATIONS

International Search Report dated Apr. 23, 2019, for International Application No. PCT/JP2019/004073, 4 pages.

*Primary Examiner* — Anatoly Vortman
(74) *Attorney, Agent, or Firm* — Knobbe, Martens, Olson & Bear LLP

(57) ABSTRACT

A breaker has a fixed contact, a movable piece which has an elastic portion formed in a plate shape and being elastically deformable, and a movable contact in one end portion of the elastic portion so as to press the movable contact against the fixed contact, a thermally-actuated element which is deformed in accordance with a temperature change and shifts from a conduction state in which the movable contact contacts with the fixed contact to a shut-off state in which the movable contact separates from the fixed contact, and a case which accommodates the fixed contact, the movable piece, and the thermally-actuated element. The case has a side wall extending in a long direction of the movable piece, and the side wall is provided, in an adjacent portion to the thermally-actuated element, with a convex portion protruding toward the outside of the case.

12 Claims, 8 Drawing Sheets

(51) Int. Cl.
*H01H 1/50* (2006.01)
*H01H 71/02* (2006.01)

(58) Field of Classification Search
USPC ..... 337/14
See application file for complete search history.

(56) References Cited

U.S. PATENT DOCUMENTS 5,607,610 A * 3/1997 Furukawa ..... H01M 50/581 219/505
5,847,637 A * 12/1998 Takeda ..... H01H 37/5427 337/344
6,396,381 B1 * 5/2002 Takeda ..... H01H 1/504 337/342
6,559,752 B1 * 5/2003 Sienkiewicz ..... H01H 37/5418 337/343
6,633,222 B2 * 10/2003 Nagai ..... H01M 50/572 337/365
8,289,124 B2 * 10/2012 Hofsaess ..... H01H 37/5427 337/372
9,159,985 B2 * 10/2015 Nakanishi ..... H01H 37/14
9,460,876 B2 * 10/2016 Namikawa ..... H01H 37/5427
9,653,240 B2 * 5/2017 Namikawa ..... H01H 37/04
9,831,054 B2 * 11/2017 Chen ..... H01H 37/52
2002/0003465 A1 * 1/2002 Takeda ..... H01H 37/5427 337/298
2014/0285308 A1 * 9/2014 Namikawa ..... H01H 37/04 337/1
2014/0334055 A1 * 11/2014 Namikawa ..... H01H 37/04 361/115
2016/0035521 A1 * 2/2016 Namikawa ..... H01H 37/5427 337/380

FOREIGN PATENT DOCUMENTS

JP 3185917 U 8/2013
JP 2014-35993 A 2/2014
JP 2014-120379 A 6/2014
JP 2015-162448 A 9/2015
WO WO 2011/105175 A1 9/2011
WO WO 2014/171515 A1 10/2014

* cited by examiner

BREAKER AND SAFETY CIRCUIT EQUIPPED WITH THE SAME

TECHNICAL FIELD

The present invention relates to a minisized circuit breaker suitable for use in a safety circuit of an electrical equipment.

BACKGROUND ART

Conventionally, a breaker has been used as a protection device (safety circuit) for a secondary battery, a motor and the like of various electrical equipments.

When an abnormality occurs, e.g. when the temperature of a secondary battery during charging/discharging rises excessively, or when an overcurrent flows through a motor or the like installed in an equipment of an automobile, a home appliance and the like, the breaker cuts off the current to protect the secondary battery, motor and the like.

The breaker used as such a protection device is required to operate accurately (to have good temperature characteristics) in accordance with temperature change in order to ensure the safety of the equipment as well as to have a stable resistance value when the current flows through.

The breaker is provided with a thermally-actuated element which, according to the temperature change, operates to turn on or turn off the current.

Patent Document 1 discloses a breaker using a bimetal as a thermally-actuated element. A bimetal is an element, which is formed by laminating two types of plate-like metal materials having different coefficients of thermal expansion, and which changes its shape according to the temperature change in order to control the conduction state of the contacts.

The breaker disclosed in this document is formed by housing in its case, a fixed piece, a terminal piece, a movable piece, a thermally-actuated element, a PTC thermistor and the like. And terminals of the fixed piece and terminal piece protrude from the case to be connected to an electric circuit of an equipment to use the breaker.

PRIOR ART DOCUMENT

Patent Document

Patent Document 1: Japanese Patent Application Publication No. 2015-162448

SUMMARY OF THE INVENTION

Problem to be Solved by the Invention

On the other hand, when a breaker is used as a protection device for a secondary battery provided in an electrical equipment, e.g. a notebook size personal computer, a tablet type portable information terminal device, a thin multifunctional mobile phone called smartphone and the like, miniaturization is required for the breaker in addition to the safety as described above.

In recent years, especially, users have a strong desire for miniaturization (thinness) of portable information terminal devices, therefore, devices newly launched on the market by various manufacturers have a pronounced tendency to be designed to be small in order to ensure superiority in the design. Against this background, a breaker which is mounted together with a secondary battery as a component of a portable information terminal device is also strongly required to be further miniaturized.

In a breaker whose case is required to be miniaturized, there is a tendency that rigidity and strength (resistance to pressure) of the case becomes low. Therefore, in the breaker disclosed in Patent Document 1, a cover piece is embedded in the top wall in order to compensate for the decrease in the resistance to pressure of the case.

In recent years, however, the use of breakers is expanding, and in the use where a high load is applied to the case, a technique for further improving the resistance to pressure is demanded.

The present invention was made to solve the above problems, and a primarily object of the present invention is to provide a breaker capable of improving the resistance to pressure of the case while improving the temperature characteristics.

Means for Solving the Problems

In order to achieve the above-mentioned object, the present invention is a breaker comprising a fixed contact, a movable piece having an elastic portion formed in the form of a plate and being elastically deformable, and a movable contact in one end portion of the elastic portion, and pressing the movable contact against the fixed contact so as to contact therewith, a thermally-actuated element deforming with a change in the temperature so as to shift the movable piece from a conduction state in which the movable contact contacts with the fixed contact to a turn-off state in which the movable contact is separated from the fixed contact, and a case accommodating the fixed piece, the movable piece, the thermally-actuated element, characterized in that the case has a side wall extending in a long direction of the movable piece, and the side wall is provided, around the thermally-actuated element, with a convex portion protruding toward the outside of the case.

In the breaker according to the present invention, it is preferable that the case has a top wall which intersects with the side wall, a cover piece formed in the form of a plate is embedded in the top wall, the cover piece has a wide portion extending in the protruding direction of the convex portion, and a length in the long direction, of the wide portion is larger than a length in the long direction, of the convex portion.

In the breaker according to the present invention, it is preferable that the case includes a first resin case having an accommodation recess for accommodating the thermally-actuated element, and a second resin case fixed to the first resin case and covering the accommodation recess, the convex portion is provided on the first resin case, and the top wall is provided on the second resin case.

In the breaker according to the present invention, it is preferable that the first resin case has a bottom wall intersecting with the side wall, and further provided with a terminal piece having a terminal exposed from the bottom wall to be connected to an external circuit, and when viewed in a thickness direction of the elastic portion, the wide portion overlaps with at least a part of the terminal piece.

In the breaker according to the present invention, it is preferable that a region where the wide portion and the terminal piece overlap each other, is filled with resin.

In the breaker according to the present invention, it is preferable that the terminal piece has a bent portion bent toward the wide portion.

In the breaker according to the present invention, it is preferable that the wide portion overlaps with the bent portion when viewed in the thickness direction of the elastic portion.

In the breaker according to the present invention, it is preferable that at least a part of the terminal piece is embedded in the convex portion.

A safety circuit for electrical equipment of the present invention is characterized by including the breaker.

Effect of the Invention

According to the breaker of the present invention, since the side wall of the case is provided, around the thermally-actuated element, with the convex portion protruding toward the outside of the case, the thickness of the side wall around the thermally-actuated element can be easily secured, and it becomes possible to improve the rigidity and strength of the case.

Further, the inner volume of the case can be easily increased by the convex portion, and it becomes possible to employ a large sized thermally-actuated element. As a result, the operating temperature and the reset temperature of the thermally-actuated element are stabilized, and temperature characteristics of the breaker are easily improved.

BRIEF DESCRIPTION OF THE DRAWINGS

FIG. 7 is a plan view of the breaker seen through the case and the like.

MODE FOR CARRYING OUT THE INVENTION

A breaker according to an embodiment of a first invention of the present invention will be described with reference to the drawings.

FIGS. 1 to 4 show the configuration of the breaker.

Figure 1:
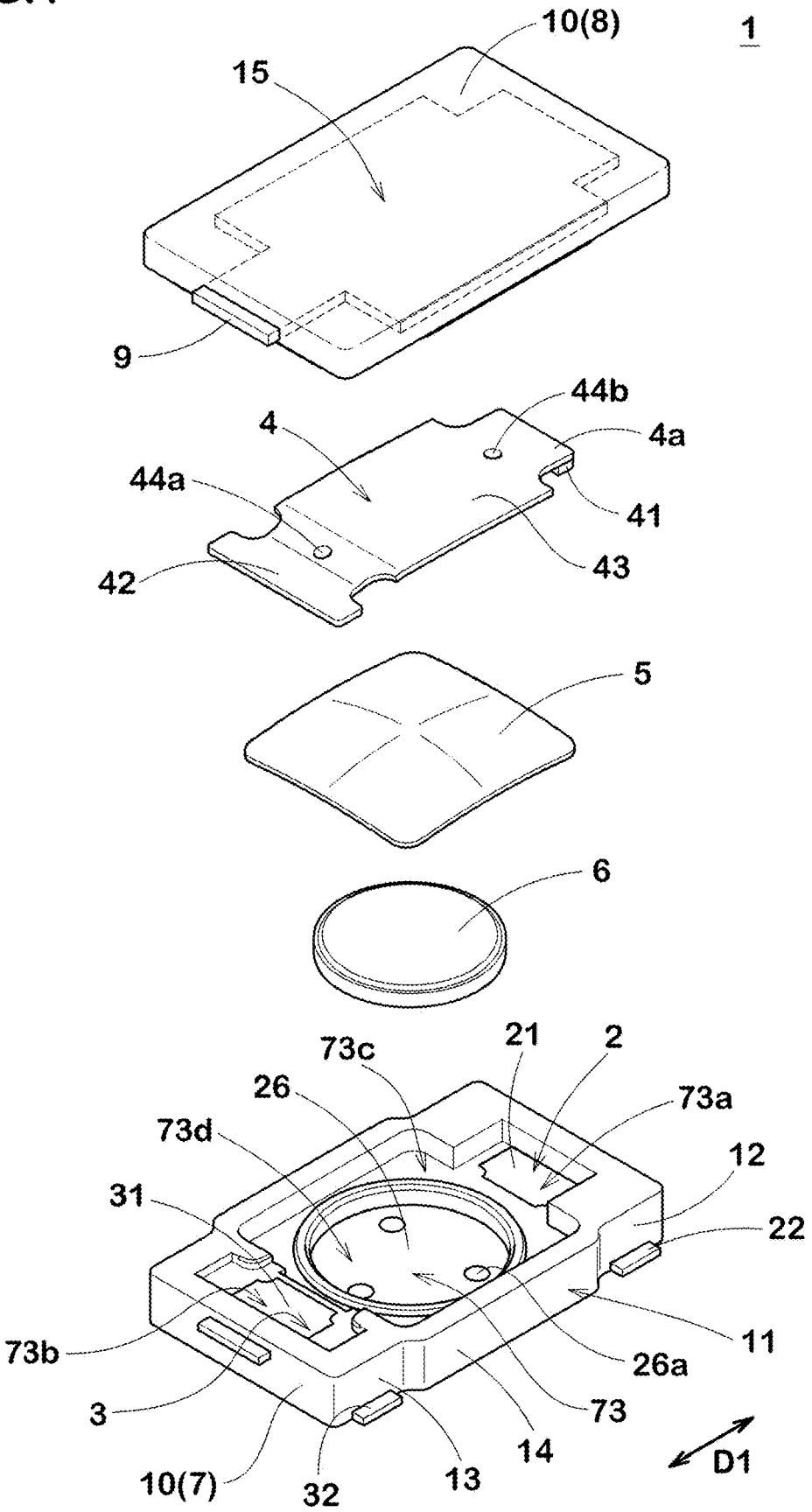
FIG. 1 is a perspective view showing a schematic configuration before assembled, of a breaker according to an embodiment of the present invention.
Figure 4:
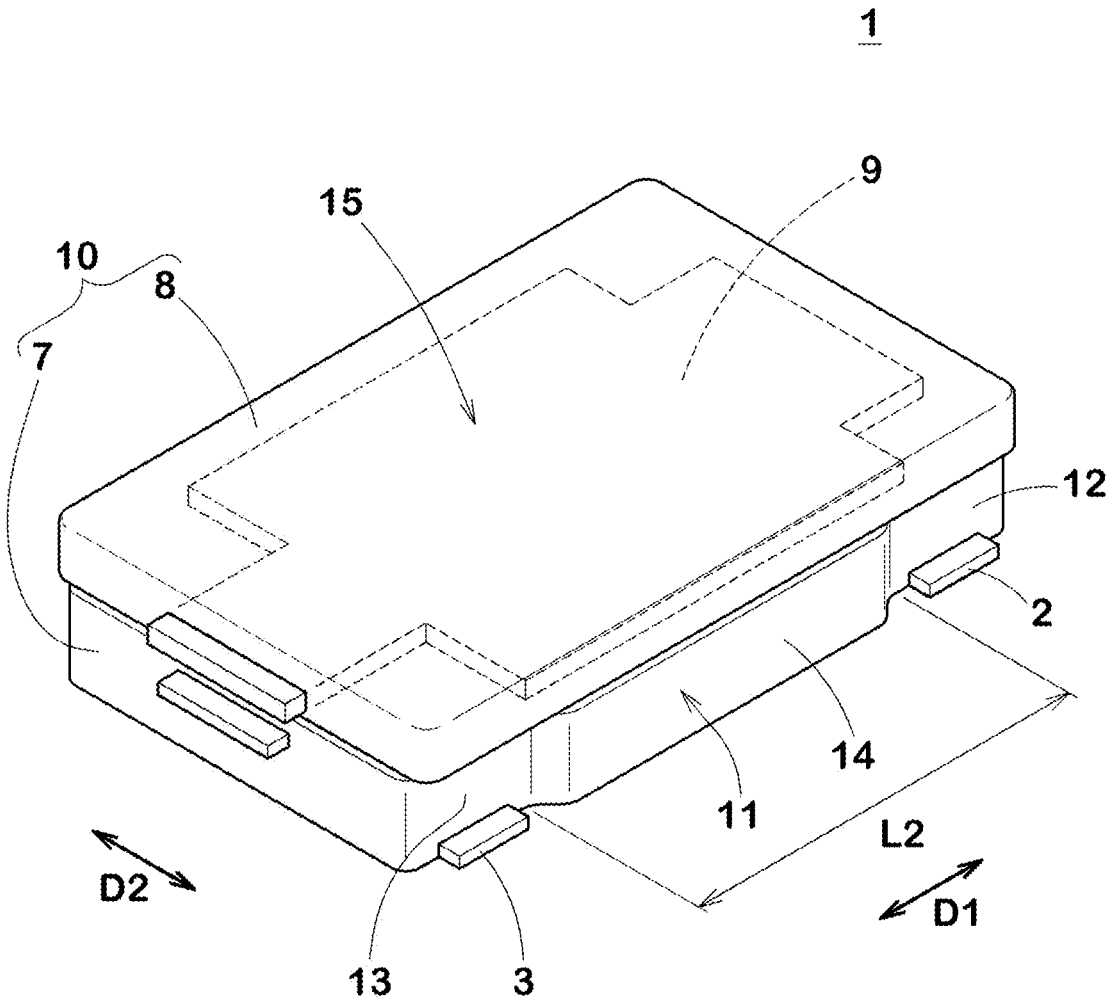
FIG. 4 is a perspective view of the breaker viewed from the first surface (top surface) side.

As shown in FIGS. 1 and 4, the breaker 1 has a pair of terminals 22, 32 partially exposed to the outside of the case 10.

The breaker 1 constitutes a main part of a safety circuit of an electric device by electrically connecting the terminals 22, 32 to the external circuit (not shown).

As shown in FIG. 1, the breaker 1 is composed of a first terminal piece (fixed piece) 2 having a fixed contact 21 and a terminal 22, a second terminal piece 3 having a terminal 32, a movable piece 4 provided, in a tip portion thereof, with a movable contact 41, a thermally-actuated element 5 which changes its shape according to temperature change, a PTC (Positive Temperature coefficient) thermistor 6, a case 10 accommodating the first terminal piece 2, the second terminal piece 3, the movable piece 4, the thermally-actuated element 5, and the PTC thermistor 6, and the like.

The case 10 is made up of a case main body (first resin case) 7, a lid member (second resin case) 8 mounted on the upper surface of the case main body 7, and the like.

The first terminal piece 2 is formed, for example, by pressing a metal plate containing copper as a main component (other than this, metal plates of copper-titanium alloy, nickel silver, brass, etc.), and is embedded in the case main body 7 by insert molding.

The fixed contact 21 is formed by clading, plating or coating of a material having good conductivity such as silver, nickel, nickel-silver alloy, copper-silver alloy, gold-silver alloy.

The fixed contact 21 is formed at a position opposite to the movable contact 41 of the first terminal piece 2, and is exposed to the accommodation recess 73 of the case main body 7 from a part of an opening 73*a* formed inside the case main body 7. The fixed contact 21 and the terminal 22 are arranged at different heights by a stepped bent portion (not shown) embedded in the case main body 7.

In the present application, unless otherwise specified, in the first terminal piece 2, the surface on which the fixed contact 21 is formed (that is, the upper surface in FIG. 1) is described as a first surface, and the bottom surface on the opposite side is described as a second surface.

The same applies to other components, e.g. the second terminal piece 3, the movable piece 4, the thermally-actuated element 5, the case 10, the cover piece 9, and the like.

Figure 5:
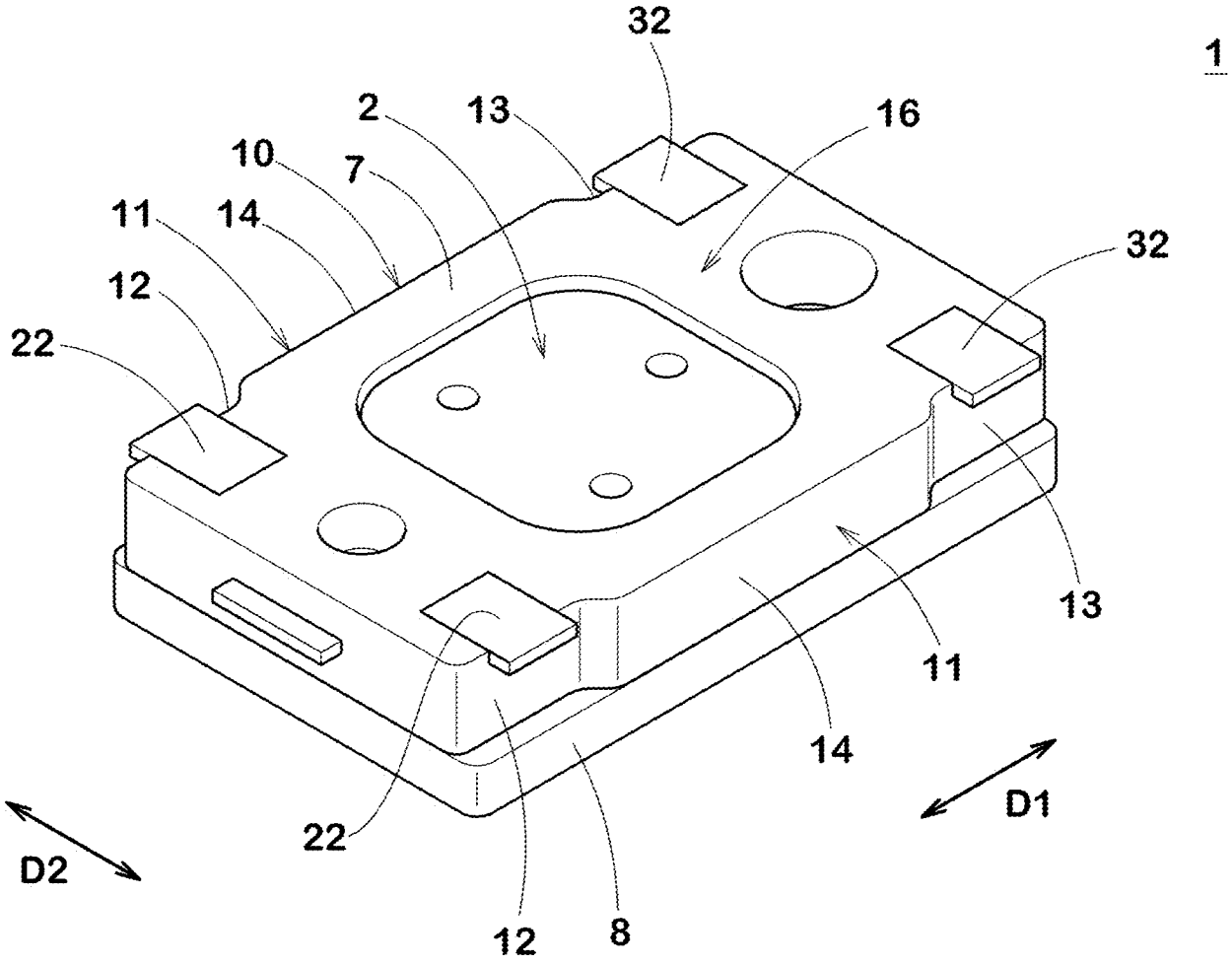
FIG. 5 is a perspective view of the breaker viewed from the second surface (bottom surface) side.

As shown in the after-mentioned FIG. 5 and others, the terminal 22 is exposed from the bottom wall 16 of the case main body 7, presenting a rectangular shape, and connected to a land portion of a circuit board through a technique of soldering or the like.

In the present embodiment, a pair of the terminals 22 are arranged side by side in the short direction of the breaker 1.

Figure 2:
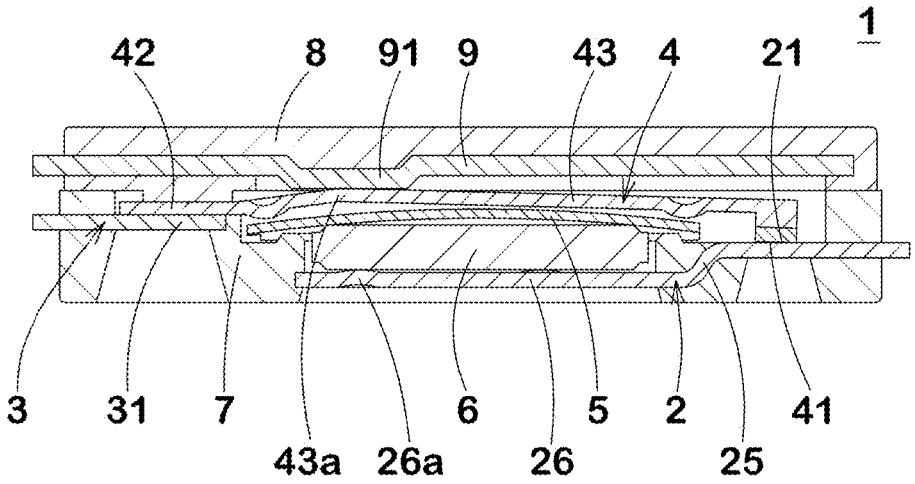
FIG. 2 is a cross-sectional view showing the breaker in a normal charging and discharging state.

As shown in FIG. 2, the first terminal piece 2 has a stepped bent portion 25 bent in a step shape (a crank shape in a side view), and a support portion 26 supporting the PTC thermistor 6.

The stepped bent portion 25 connects the fixed contact 21 and the support portion 26, and arranges the fixed contact 21 and the support portion 26 at different heights.

The PTC thermistor 6 is placed on convex protrusions (DABO) 26*a* formed at three locations on the support portion 26, and supported by the protrusions 26*a*.

The second terminal piece 3 is formed by pressing a metal plate containing copper or the like as a main component, similarly to the first terminal piece 2, and embedded in the case main body 7 by insert molding.

The second terminal piece 3 has a connecting portion 31 connected to the movable piece 4, and a terminal 32.

The connecting portion 31 and the terminal 32 are arranged at different heights by a stepped bent portion (not shown) embedded in the case main body 7.

The connecting portion 31 is exposed to the accommodation recess 73 of the case main body 7 from a part of a opening 73*b* formed inside the case main body 7, and is electrically connected to the movable piece 4.

On the other hand, as shown in FIG. 4, the terminal 32 is exposed from the bottom wall 16 of the case main body 7, presenting a rectangular shape, and is connected to a land portion of a circuit board through a technique of soldering or the like.

In the present embodiment, a pair of the terminals 32 are arranged side by side in the short direction of the breaker 1.

The movable piece 4 is formed in the form of a plate by pressing a metal material whose main component is copper or the like.

The movable piece 4 is formed in the form of an arm symmetrical about the center line in the long direction.

In one of end portions of the movable piece 4, the movable contact 41 is formed. The movable contact 41 is formed on the second surface of the movable piece 4 with the same material as that of the fixed contact 21, and is joined to a tip end portion of the movable piece 4 through a technique of welding, clading, caulking (crimping) or the like.

In the other of the end portions of the movable piece 4, there is formed a connecting portion 42 electrically connected to the connecting portion 31 of the second terminal piece 3. The first surface of the connecting portion 31 of the second terminal piece 3 and the second surface of the connecting portion 42 of the movable piece 4 are fixed to each other by laser welding for example.

Laser welding is a welding technique in which laser light is applied to objects (corresponding to the second terminal piece 3 and the movable piece 4 in the present embodiment), and the objects are locally melted and solidified to join the objects. On the surface of the objects irradiated with the laser light, there are formed laser welding marks having a different form than welding marks formed by another welding method (for example, resistance welding using Joule heat).

The movable piece 4 has an elastic portion 43 between the movable contact 41 and the connecting portion 42. The elastic portion 43 extends from the connecting portion 42 toward the movable contact 41. Thereby, the connecting portion 42 is provided, on the opposite side of the movable contact 41, with the elastic portion 43 interposed therebetween.

In the connecting portion 42, the movable piece 4 is fixed by being fixed to the connecting portion 31 of the second terminal piece 3.

When the elastic portion 43 is elastically deformed, the movable contact 41 formed at the tip thereof is pressed toward the fixed contact 21 and contacts therewith, so the first terminal piece 2 and the movable piece 4 becomes a state in which electricity can flow therebetween.

Since the movable piece 4 and the second terminal piece 3 are electrically connected at the connecting portion 31 and the connecting portion 42, the first terminal piece 2 and the second terminal piece 3 becomes a state in which electricity can flow therebetween.

The movable piece 4 is curved or inflected in the elastic portion 43 by press working. The degree of curving or inflecting is not particularly limited as long as the thermally-actuated element 5 can be accommodated, and may be appropriately set in consideration of the elastic force, the pressing force of the contacts and the like at the operating temperature and the reset temperature.

Further, on the second surface of the elastic portion 43, there are formed a pair of protrusions (contact portions) 44*a*, 44*b* so as to face the thermally-actuated element 5.

Figure 3:
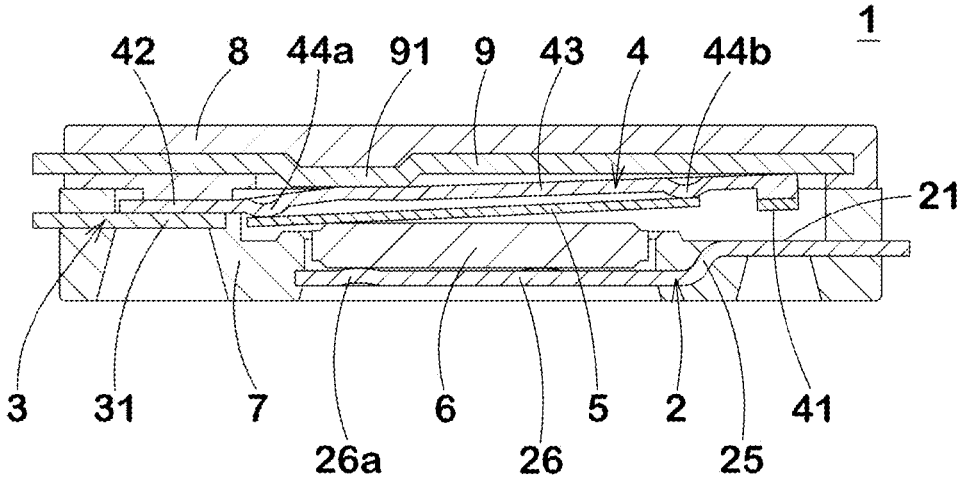
FIG. 3 is a cross-sectional view showing the breaker in an overcharged state or under abnormality.

The protrusions 44*a*, 44*b* come into contact with the thermally-actuated element 5, and the deformation of the thermally-actuated element 5 is transmitted to the elastic portion 43 via the protrusions 44*a*, 44*b* (see FIG. 1 and FIG. 3).

The thermally-actuated element 5 shifts from a conduction state in which the movable contact 41 contacts with the fixed contact 21 to a shut-off state in which the movable contact 41 separates from the fixed contact 21.

The thermally-actuated element 5 has an initial shape which is curved in an arc shape, and is formed by laminating thin plate materials having different thermal expansion coefficients.

The curved shape of the thermally-actuated element 5 is reversely warped with snap motion when reaching to the operating temperature due to overheating, and restores when falling below the reset temperature due to cooling.

The initial shape of the thermally-actuated element 5 can be provided by pressing.

The material and shape of the thermally-actuated element 5 are not particularly limited as long as the elastic portion 43 of the movable piece 4 is pushed up by the reverse warping motion of the thermally-actuated element 5 at the desired temperature and returned to its original state by the elastic force of the elastic portion 43.

However, a rectangular shape is preferred from the viewpoint of productivity and the efficiency of the reverse warping motion, and a rectangular shape close to a square is desirable in order to efficiently push up the elastic portion 43 while being small.

As to the materials of the thermally-actuated element 5, two kinds of materials having different coefficients of thermal expansion, for example, various alloys, copper-nickel-manganese alloy or nickel-chromium-iron alloy on the high expansion side, and iron-nickel alloy, nickel silver, brass, stainless steel or the like on the low expansion side, are combined and laminated to be used according to required conditions.

The PTC thermistor 6 electrically connects the first terminal piece 2 and the movable piece 4 when the movable piece 4 is in the cutoff state.

The PTC thermistor 6 is disposed between the support portion 26 of the first terminal piece 2 and the thermally-actuated element 5. That is, the support portion 26 is located immediately below the thermally-actuated element 5 with the PTC thermistor 6 interposed therebetween.

When the electric current between the first terminal piece 2 and the movable piece 4 is intercepted due to the reverse warping motion of the thermally-actuated element 5, the electric current flowing through the PTC thermistor 6 is increased.

The type of the PTC thermistor 6 can be selected according to the needs of the operating current, the operating voltage, the operating temperature, the reset temperature, etc. as long as it is a positive temperature coefficient thermistor of which resistance value increases as the temperature rises so as to limit the current. And as long as these characteristics are not impaired, the material and shape are not particularly limited. In this embodiment, a ceramic sintered body containing barium titanate, strontium titanate or calcium titanate is used. Aside from a ceramic sintered body, so-called polymer PTC in which a polymer contains conductive particles such as carbon may be used.

The case main body 7 and the lid member 8 which constitutes the case 10 are formed from a thermoplastic resin, e.g. flame-retardant polyamide, polyphenylene sulfide (PPS) having excellent heat resistance, liquid crystal polymer (LCP), polybutylene terephthalate (PBT), and the like.

As long as the characteristics equal to or higher than those of the above-mentioned resins can be obtained, materials other than resins may be used.

The case main body 7 is provided with the accommodation recess 73 which is an internal space accommodating the movable piece 4, the thermally-actuated element 5, the PTC thermistor 6, and the like.

The accommodation recess 73 has the openings 73*a* and 73*b* for accommodating the movable piece 4, an opening 73*c* for accommodating the movable piece 4 and the thermally-actuated element 5, an opening 73*d* for accommodating the PTC thermistor 6 and the like. The edges of the movable piece 4 and the thermally-actuated element 5 incorporated in the case main body 7 contact with frames formed inside the accommodation recess 73, and are guided during the thermally-actuated element 5 is reversely warping.

In the lid member 8, the cover piece 9 is embedded by insert molding.

The cover piece 9 is formed in the form of a plate by pressing the above-mentioned metal containing copper as a main component or the like, or a metal such as stainless steel.

As shown in FIG. 2 and FIG. 3, the cover piece 9 appropriately abuts the first surface of the movable piece 4 to restrict the movement of the movable piece 4, and at the same time, contributes to the miniaturization of the breaker 1, while increasing the rigidity and strength of the lid member 8 and thus the case 10.

As shown in FIG. 1, the lid member 8 is attached to the case main body 7 so as to close the openings 73*a*, 73*b*, 73*c*, etc. of the case main body 7 having accommodated the first terminal piece 2, the second terminal piece 3, the movable piece 4, the thermally-actuated element 5, the PTC thermistor 6, etc. The case main body 7 and the lid member 8 are joined by, for example, ultrasonic welding. At this time, the case main body 7 and the lid member 8 are continuously joined over the entire circumference of the respective outer edge portions, and the airtightness of the case 10 is improved. Thereby, the internal space of the case 10 provided by the accommodation recess 73 is hermetically sealed, and the movable piece 4, the thermally-actuated element 5, the PTC thermistor 6, and the like can be protected by being shielded from the atmosphere outside the case 10.

In the present embodiment, since the resin is wholly disposed on the first surface side of the cover piece 9, the airtightness of the accommodation recess 73 is further enhanced.

FIG. 2 shows the operation of the breaker 1 in a normal charging and discharging state.

In the normal charging and discharging, the thermally-actuated element 5 maintains its initial shape (before reverse warpage). The cover piece 9 is provided with a protruding portion 91 abutting on a top portion 43*a* of the movable piece 4, and pressing the top portion 43*a* toward the thermally-actuated element 5.

When the protruding portion 91 presses the top portion 43*a*, the elastic portion 43 is elastically deformed, and the movable contact 41 which is formed at the tip of the elastic portion 43 is pressed toward the fixed contact 21 and comes into contact therewith. Thereby, the first terminal piece 2 and the second terminal piece 3 of the breaker 1 are electrically connected to each other through the elastic portion 43 of the movable piece 4 and the like.

The elastic portion 43 of the movable piece 4 and the thermally-actuated element 5 may be in contact with each other, and the movable piece 4, the thermally-actuated element 5, the PTC thermistor 6, and the first terminal piece 2 may be electrically connected as a circuit.

However, as the resistance of the PTC thermistor 6 is overwhelmingly higher than the resistance of the movable piece 4, the current flowing through the PTC thermistor 6 can be ignored in substance when compared with the current flowing through the fixed contact 21 and the movable contact 41.

FIG. 3 shows the operation of the breaker 1 in its overcharged state or abnormal state. When the temperature changes to a high temperature due to overcharging or abnormality, the thermally-actuated element 5 having reached the operating temperature warps reversely, and the elastic portion 43 of the movable piece 4 is pushed up, so the fixed contact 21 and the movable contact 41 are separated from each other.

The operating temperature of the thermally-actuated element 5 when the thermally-actuated element 5 is deformed within the breaker 1 and the movable piece 4 is pushed up, is for example 70 deg. C. to 90 deg. C.

At this time, the current flowing between the fixed contact 21 and the movable contact 41 is cut off, and a slight leakage current flows through the thermally-actuated element 5 and the PTC thermistor 6.

As long as such leakage current flows, the PTC thermistor 6 continues to generate heat, and dramatically increases the resistance value while maintaining the thermally-actuated element 5 in the reverse warped state, so the current does not flow between the fixed contact 21 and the movable contact 41, and only the above-mentioned slight leakage current exists (constituting a self-holding circuit). This leakage current can be used for other functions of the safety device.

FIG. 4 is a perspective view showing the breaker 1 viewed from the first surface side, and FIG. 5 is a perspective view showing the breaker 1 viewed from the second surface side. As shown in FIGS. 4 and 5, the case 10 has side walls 11 extending in the long direction Dl of the movable piece 4.

The side wall 11 has an adjacent portion 12 to the first terminal piece 2, an adjacent portion 13 to the second terminal piece 3, and a convex portion 14 protruding toward the outside of the case 10.

The convex portion 14 is formed between the adjacent portion 12 and the adjacent portion 13, and protrudes in the short direction D2 orthogonal to the long direction D1, from the adjacent portion 12 and the adjacent portion 13.

The convex portion 14 is formed around the thermally-actuated element 5, that is, on the outside in the short direction D2, of the outer edge of the opening 73*c* (see FIG. 1) for accommodating the thermally-actuated element 5.

As the side wall 11 of the case 10 is provided with the convex portion 14, the side wall 11 can easily secure a thickness around the thermally-actuated element 5, and it becomes possible to increase the rigidity and strength of the case 10.

In the case of the breaker disclosed in the above-mentioned Patent Document 1, the resistance to pressure of the case tends to be insufficient because it is necessary to provide an accommodation recess within the case, for accommodating the movable piece and the thermally-actuated element in a deformable manner.

However, in the case of the breaker 1, as the protrusion 14 is formed in the side wall 11, the thickness of the side wall 11 can be easily secured around the accommodation recess 73, and it becomes possible to increase the rigidity and strength of the case 10.

Further, by the convex portion 14, the inner volume of the case can be easily increased, while maintaining the thickness of the side wall 11 at a certain value or more, and it becomes possible to employ the thermally-actuated element 5 having a large size. As a result, the operating temperature and the reset temperature of the thermally-actuated element 5 are stabilized, and the temperature characteristics of the breaker 1 are improved with ease.

Further, such a large-sized thermally-actuated element 5 is easy to be fabricated, and as a result, the degree of freedom in selecting the materials forming the thermally-actuated element 5 is increased. For example, it becomes possible to make the thermally-actuated element 5 from materials more excellent in chemical stability or cheaper materials.

The case 10 has the side wall 11 and the top wall 15 which intersects the side wall 11 at the upper end thereof. The top wall 15 is constituted by the lid member 8. In the top wall 15, the cover piece 9 is embedded. The case 10 has the side wall 11 and the bottom wall 16 which intersects the side wall 11 at the lower end thereof. The bottom wall 16 is constituted by the case main body 7. The terminals 22 and 32 are exposed from the bottom wall 16.

Figure 6:
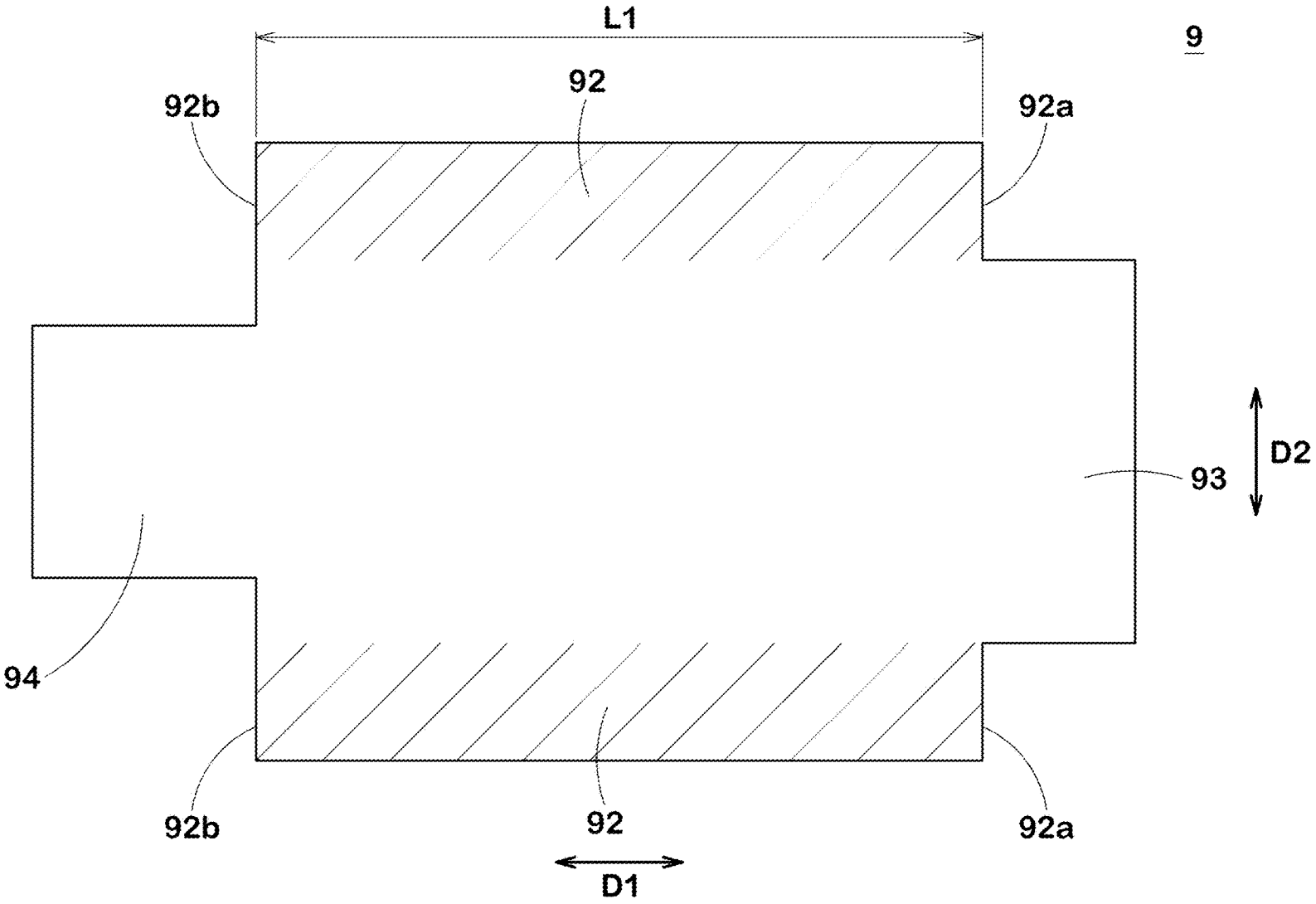
FIG. 6 is a plan view of a cover piece.

FIG. 6 shows the cover piece 9. The cover piece 9 has wide portions 92 which are indicated by hatching in FIG. 6. The wide portions 92 are made wider in the short direction D2 by being extended in the short direction D2 as compared with a region 93 facing the fixed contact 21 through the movable piece 4, and a region 94 facing the connecting portion 31 through the movable piece 4.

That is, the direction in which the convex portion 14 protrudes and the direction in which the wide portion 92 extends are the short direction D2.

By forming the wide portion 92 on the cover piece 9, the top wall 15 of the case 10 is reinforced over a wider area, and the resistance to pressure of the case 10 is enhanced.

Figure 7:
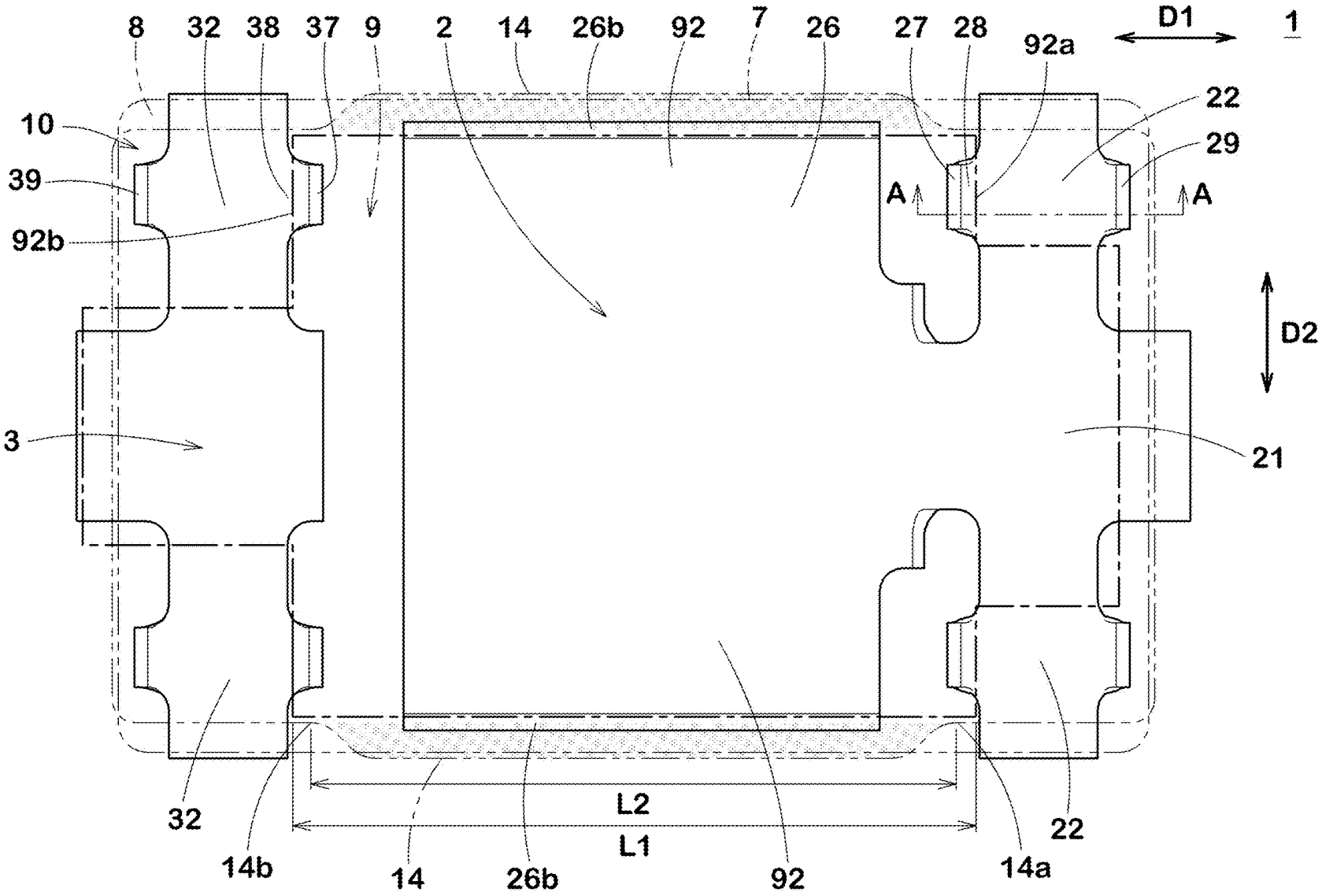

In the present embodiment, the length L1 in the long direction, of the wide portion 92 is larger than the length L2 in the long direction, of the convex portion 14 (see FIGS. 4 and 7).

With such wide portion 92, the top wall 15 of the case 10 is reinforced over a wider area, and particularly, the side wall 11 is further reinforced in the convex portion 14 and the adjacent area thereof.

It is preferable that the edges 92*a* of the wide portions 92 on a tip 4*a* side of the movable piece 4 are positioned on the tip 4*a* side than an edge 14*a* on the tip 4*a* side, of the convex portion 14.

With such wide portion 92, the side wall 11 is further reinforced from the convex portion 14 to the adjacent portion 12 to the first terminal piece 2.

It is preferable that the edges 92*b* of the wide portions 92 on the connecting portion 42 side of the movable piece 4 are positioned on the connecting portion 42 side than an edge 14*b* on the connecting portion 42 side, of the protruding portion 14. With such wide portion 92, the side wall 11 is further reinforced from the convex portion 14 to the adjacent portion 13 to the second terminal piece 3.

The convex portion 14 is provided on the case main body 7. The top wall 15 is provided on the lid member 8. That is, the cover piece 9 having the wide portion 92 is embedded in the lid member 8. With such configuration, the case main body 7 and the lid member 8 are reinforced in a well-balanced manner, and the resistance to pressure of the case 10 is efficiently enhanced.

FIG. 7 is a plan view of the breaker 1 seen through the case 10 and the like. In this figure, the outlines of the case main body 7 and the lid member 8 which form the case 10 are shown by a two-dot chain line, the first terminal piece 2 and the second terminal piece 3 are depicted by solid lines, and the cover piece 9 is depicted by a dashed-dotted line. Further, the area of the convex portion 14 in this figure is indicated by dot shading.

Since the elastic portion 43 extends substantially parallel to the top wall 15 of the breaker 1, the first terminal piece 2, the second terminal piece 3 and the cover piece 9 in FIG. 7 substantially conform with the shapes of the first terminal piece 2, the second terminal piece 3 and the cover piece 9 which are viewed in the thickness direction of the elastic portion 43.

The first terminal piece 2 has a protruding portion 27 which protrudes from the terminal 22 toward the second terminal piece 3 (inside in the long direction D1).

The protruding portion 27 is arranged so as to face the support portion 26.

The wide portion 92 of the cover piece 9 overlaps with the protruding portion 27 of the first terminal piece 2. As a result, the resistance to pressure of the case 10 is further enhanced.

Figure 8:
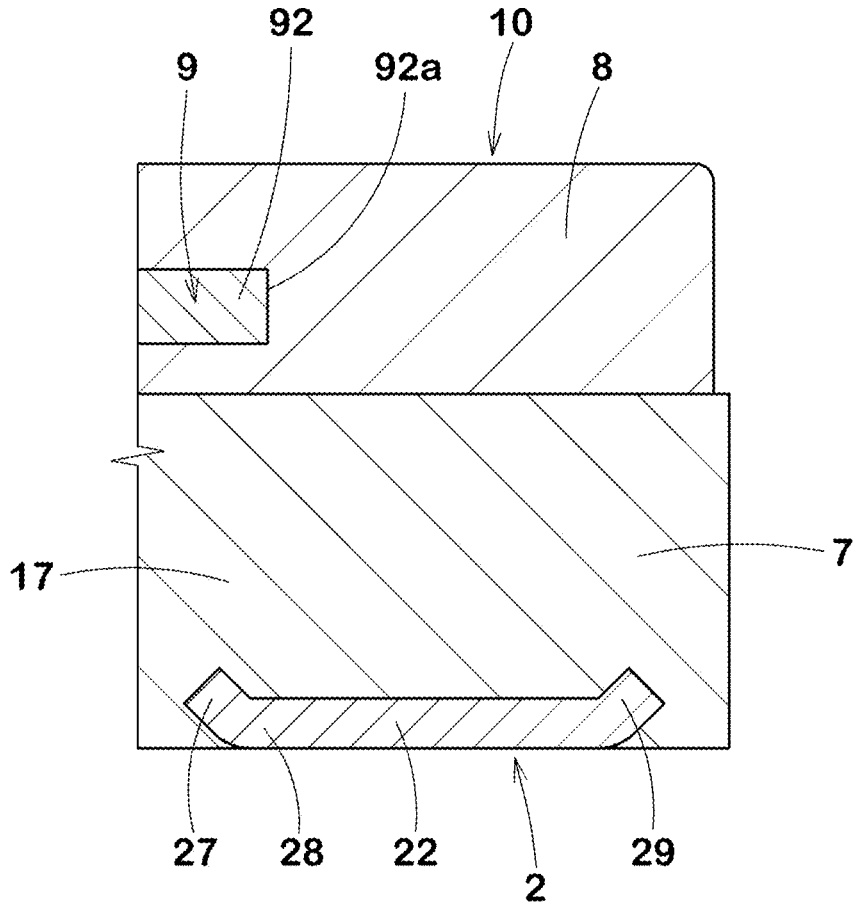
FIG. 8 is a cross-sectional view taken along line A-A of FIG. 7.

FIG. 8 shows a cross-sectional view taken along line A-A of FIG. 7, that is, cross sections of the first terminal piece 2 and adjacent portion thereto in parallel with the long direction D1.

In the inside of the case 10, a resin 17 is filled between the wide portion 92 and the protruding portion 27, that is, in a region where the wide portion 92 and the first terminal piece 2 overlap in the plan view.

In the present embodiment, the resin 17 is filled continuously from the first surface of the protruding portion 27 to the second surface of the wide portion 92.

In such configuration, the resin 17 functions as a binder which integrates the wide portion 92 and the protruding portion 27, and the resistance to pressure of the case 10 is further enhanced.

In the present embodiment, it is preferable that the edge 14*a* of the convex portion 14 is disposed in the vicinity of a region where the wide portion 92 and the first terminal piece 2 overlap in the plan view.

For example, it is preferable that the both overlap in a side view as viewed in the short direction. Thereby, the resistance to pressure of the case 10 is further enhanced.

Further, the first terminal piece 2 has a bent portion 28 which is bent toward the wide portion 92. The bent portion 28 is provided at a proximal end portion of the protruding portion 27 protruding from the terminal 22. Thereby, the protruding portion 27 is inclined toward the wide portion 92.

By the bent portion 28, the first terminal piece 2 is further reinforced, and the resistance to pressure of the case 10 is further enhanced.

In addition, in the present embodiment, the resin 17 is filled also on the second surface side of the protruding portion 27, and the resistance to pressure of the case 10 is further enhanced.

Further, as shown in FIG. 7, the wide portion 92 overlaps with the bent portion 28. Thereby, the adjacent portion to the terminal 22 is reinforced, and the resistance to pressure of the case 10 is further enhanced.

As shown in FIG. 7, the first terminal piece 2 may have a protrusion 29 which protrudes from the terminal 22 in the opposite direction (outward in the long direction Dl) to the protruding portion 27.

Further, a bent portion may be provided at the proximal end portion of the protruding portion 29 protruding from the terminal 22.

Similarly to the first terminal piece 2, the second terminal piece 3 has a protruding portion 37 which protrudes from the terminal 32 toward the first terminal piece 2. The protruding portion 37 is disposed so as to face the support portion 26 of the first terminal piece 2.

It is preferable that the wide portion 92 of the cover piece 9 overlaps with the protruding portion 37 of the second terminal piece 3. Thereby, the resistance to pressure of the case 10 is further enhanced.

In the inside of the case 10 in the present embodiment, the resin 17 is also filled between the wide portion 92 and the protruding portion 37, that is, in a region where the wide portion 92 and the second terminal piece 3 overlap.

In such configuration, the resin 17 functions as a binder which integrates the wide portion 92 and the protruding portion 37, and the resistance to pressure of the case 10 is further enhanced.

In the present embodiment, it is preferable that the edge 14*b* of the convex portion 14 is disposed in the vicinity of a region where the wide portion 92 and the second terminal piece 3 overlap in the plan view.

For example, it is preferable that the both overlap in a side view as viewed in the short direction. Thereby, the resistance to pressure of the case 10 is further enhanced.

Further, the second terminal piece 3 has a bent portion 38 which is bent toward the wide portion 92. The bent portion 38 is provided at a proximal end portion of the protruding portion 37 protruding from the terminal 32. Thereby, the protruding portion 37 is inclined toward the wide portion 92. By the bent portion 38, the second terminal piece 3 is further reinforced, and the resistance to pressure of the case 10 is further enhanced.

In the present embodiment, the resin 17 is also filled on the second surface side of the protruding portion 37, and the resistance to pressure of the case 10 is further enhanced.

Further, it is preferable that the wide portion 92 overlaps the bent portion 38. Thereby, the adjacent portion to the terminal 32 is reinforced, and the resistance to pressure of the case 10 is further enhanced.

The second terminal piece 3 may have a protrusion 39 which protrudes from the terminal 32 in the opposite direction (outward in the long direction D1) to the protruding portion 37. Further, a bent portion may be provided at the proximal end portion of the protruding portion 39 protruding from the terminal 32.

The support portion 26 of the first terminal piece 2 has edge portions 26*b* in the short direction D2. The edge portions 26*b* are bent and inclined toward the lid member 8. It is preferred that the edge portion 26*b* extends to the convex portion 14 and is embedded in the convex portion 14. With such edge portion 26*b*, the convex portion 14 is reinforced, and the resistance to pressure of the case 10 is further enhanced.

Further, in this embodiment, the resin 17 forming the side wall 11 is filled continuously from the first surface of the edge portion 26*b* to the second surface of the wide portion 92. In such configuration, the resin 17 functions as a binder which integrates the wide portion 92 and the protruding portion 27, and the resistance to pressure of the case 10 is further enhanced.

In the present embodiment, by the synergistic effect of the convex portion 14 protruding in the short direction D2, the wide portion 92 of which length in the long direction D1 is longer than the convex portion 14, and the edge portion 26*b* embedded in the convex portion 14, the side wall 11 of the case 10 is reinforced, in particular in the adjacent portion to the accommodation recess 73 for accommodating the thermally-actuated element 5.

The resistance to pressure of the case 10 is further enhanced.

The second surface of the terminal 22 is flush with (arranged at the same plane as) the second surface of the case main body 7, and the tip end in the short direction D2, of the terminal 22 protrudes in the short direction D2 from the adjacent portion 12. Thereby, the soldering to a land portion of a circuit board can be performed well.

It is preferable that the distance between the tip ends of a pair of the terminals 22, that is, the length in the short direction D2, of the first terminal piece 2 is less than the distance between a pair of the convex portions 14, that is, the length in the short direction D2, of the case main body 7. Thereby, the resistance to pressure of the case 10 is enhanced, and the miniaturization is realized.

Similarly, the second surface of the terminal 32 is flush with (arranged at the same plane as) the second surface of the case main body 7, and the tip end in the short direction D2 of the terminal 32 protrudes in the short direction D2 from the adjacent portion 13. Thereby, the soldering to a land portion of a circuit board can be performed well.

It is preferable that the distance between the tip ends of a pair of the terminals 32, that is, the length in the short direction D2, of the second terminal piece 3, is less than the distance between a pair of the convex portions 14, that is, the length in the short direction D2, of the case main body 7.

Thereby, the resistance to pressure of the case 10 is enhanced, and the miniaturization is realized.

The breaker 1 according to the present invention is not limited to the configuration of the above-described embodiment, and can be implemented in various modes. That is, it suffices for the breaker 1 to have at least the fixed contact 21, the movable piece 4 which has the elastic portion 43 formed in a plate shape and being elastically deformable, and the movable contact 41 in one end portion of the elastic portion 43, so as to press the movable contact 41 against the fixed contact 21, the thermally-actuated element 5 which is deformed in accordance with a temperature change, and shifts from a conduction state in which the movable contact 41 contacts with the fixed contact 21 to a shut-off state in which the movable contact 41 separates from the fixed contact 21, and the case 10 which accommodates the fixed contact 21, the movable piece 4, and the thermally-actuated element 5, wherein the case 10 has the side wall 11 extending in the long direction D1 of the movable piece 4, and the side wall 11 is provided, in the adjacent portion to the thermally-actuated element 5, with the convex portion 14 protruding toward the outside of the case 10.

For example, the method for joining the case main body 7 and the lid member 8 is not limited to ultrasonic welding, and any method can be appropriately employed as long as the two are firmly joined. For example, the two may be bonded together by applying/filling and curing a liquid or gel adhesive.

Further, the case 10 is not limited to the configuration formed by the case main body 7, the lid member 8 and the like, and it suffices that the case 10 is formed from at least two parts.

The case 10 may be sealed with resin or the like by secondary insert molding or the like. Thereby, the airtightness of the case 10 is further enhanced.

In the present embodiment, even when the lid member 8 is loaded with the filling pressure of the resin material during the secondary insert molding, the deformation of the case 10 can be suppressed since the case 10 is reinforced by the above-described configuration of the convex portion 14, the wide portion 92 and the like.

Furthermore, the movable piece 4 and the thermally-actuated element 5 may be integrally formed by forming the movable piece 4 from a laminated metal such as a bimetal or a trimetal. In this case, the breaker is simplified in its structure, and can be reduced in the size.

Further, the present invention may be applied to a mode in which the second terminal piece 3 and the movable piece 4 are integrally formed as disclosed in WO2011/105175.

Although the present embodiment has the self-holding circuit using the PTC thermistor 6, it is also applicable to a mode in which such configuration is omitted.

Further, the breaker 1 according to the present invention can be widely applied to secondary battery packs, safety circuits of electric devices and the like.

Figure 9:
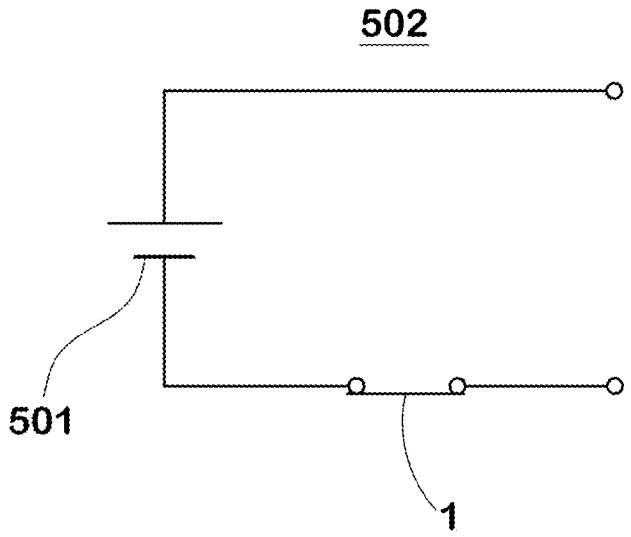
FIG. 9 is a circuit diagram of a safety circuit including the breaker of the present

FIG. 9 shows a safety circuit 502 for an electric device. The safety circuit 502 includes the breaker 1 in series in the output circuit of the secondary battery 501.

A part of the safety circuit 502 may be constituted by a cable including a connector provided with the breaker.

DESCRIPTION OF THE SIGNS

1: breaker
2: first terminal piece
3: second terminal piece
4: movable piece
5: thermally-actuated element
7: case main body
8: lid member
9: cover piece
10: case
11: side wall
14: convex portion
15: top wall
16: bottom wall
17: resin
21: fixed contact
22: terminal
**26*b***: edge portion (a part)
27: protruding portion (a part)
28: bent portion
32: terminal
37: protruding portion (a part)
38: bent portion
41: movable contact
43: elastic portion
73: accommodation recess
92: wide portion
501: secondary battery
502: safety circuit
D1: long direction
D2: short direction

The invention claimed is:

1. A breaker comprising:

a fixed contact, a movable piece comprising an elastic portion formed in the form of a plate and being elastically deformable, and a movable contact formed in one end portion of the elastic portion in a long direction of the movable piece, the movable piece for pressing the movable contact against the fixed contact so as to contact therewith, a thermally-actuated element deforming with a change in the temperature so as to shift the movable piece from a conduction state in which the movable contact contacts with the fixed contact to a turn-off state in which the movable contact is separated from the fixed contact, and a case accommodating the fixed piece, the movable piece, the thermally-actuated element, wherein the case has a side wall extending in the long direction of the movable piece, and the side wall is provided, around the thermally-actuated element, with a convex portion protruding in a short direction orthogonal to the long direction toward the outside of the case, wherein the case has a top wall which intersects with the side wall, a cover piece is formed in the form of a plate and embedded in the top wall, the cover piece is provided partially in the long direction with a wide portion wider in the short direction than other portions on both sides of the wide portion in the long direction, and a dimension in the long direction, of the wide portion of the cover piece is larger than a dimension in the long direction, of the convex portion of the side wall.

2. The breaker as set forth in claim 1, wherein the case includes a first resin case having an accommodation recess for accommodating the thermally-actuated element, and a second resin case fixed to the first resin case and covering the accommodation recess, the convex portion is provided on the first resin case, and the top wall is provided on the second resin case.

3. The breaker as set forth in claim 2, wherein the first resin case has a bottom wall intersecting with the side wall, and is further provided with a terminal piece having a terminal exposed from the bottom wall to be connected to an external circuit, and when viewed in a thickness direction of the elastic portion, the wide portion overlaps with at least a part of the terminal piece.

4. The breaker as set forth in claim 3, wherein a region where the wide portion and the terminal piece overlap each other, is filled with resin.

5. The breaker as set forth in claim 4, wherein the terminal piece has a bent portion bent toward the wide portion.

6. The breaker as set forth in claim 5, wherein the wide portion overlaps with the bent portion when viewed in the thickness direction of the elastic portion.

7. The breaker as set forth in claim 3, wherein at least a part of the terminal piece is embedded in the convex portion.

8. A safety circuit for electrical equipment comprising the breaker as set forth in claim 1.

9. The breaker as set forth in claim 1, wherein the side wall is composed of the convex portion, and a first portion and a second portion between which the convex portion is formed, and the convex portion protrudes in the short direction from the first portion and the second portion.

10. The breaker as set forth in claim 9, wherein a terminal to be connected to an external circuit protrudes in the short direction from each of the first portion and the second portion.

11. The breaker as set forth in claim 7, wherein the side wall is composed of the convex portion, and a first portion and a second portion between which the convex portion is formed, and the convex portion protrudes in the short direction from the first portion and the second portion.

12. The breaker as set forth in claim 11, wherein a terminal to be connected to an external circuit protrudes in the short direction from each of the first portion and the second portion.

* * * * *